US012396526B2

(12) United States Patent
Tamai et al.

(10) Patent No.: US 12,396,526 B2
(45) Date of Patent: Aug. 26, 2025

(54) FASTENER CHAIN

(71) Applicant: YKK Corporation, Tokyo (JP)

(72) Inventors: Satoki Tamai, Kurobe (JP); Takumi Arai, Kurobe (JP); Aditya Niranjan Abhyankar, Kurobe (JP); Mariko Nakase, Kurobe (JP)

(73) Assignee: YKK Corporation, Tokyo (JP)

( * ) Notice: Subject to any disclaimer, the term of this patent is extended or adjusted under 35 U.S.C. 154(b) by 27 days.

(21) Appl. No.: 18/695,461

(22) PCT Filed: Oct. 4, 2021

(86) PCT No.: PCT/JP2021/036676
§ 371 (c)(1),
(2) Date: Mar. 26, 2024

(87) PCT Pub. No.: WO2023/058095
PCT Pub. Date: Apr. 13, 2023

(65) Prior Publication Data

US 2024/0398073 A1 Dec. 5, 2024

(51) Int. Cl.
*A44B 19/34* (2006.01)

(52) U.S. Cl.
CPC ..... *A44B 19/34* (2013.01)

(58) Field of Classification Search
CPC ..... A44B 19/34
See application file for complete search history.

(56) References Cited

U.S. PATENT DOCUMENTS 3,082,501 A * 3/1963 Brown ..... A44B 19/32 24/389
3,594,874 A * 7/1971 Fujisaki ..... A44B 19/406 24/396

(Continued)

FOREIGN PATENT DOCUMENTS

JP 45-32840 Y1 12/1970
JP 48-33523 Y1 10/1973

(Continued)

OTHER PUBLICATIONS

International Search Report, with translation, and Written Opinion received in corresponding International Application No. PCT/JP2021/036676, mailed Nov. 9, 2021, in 10 pages.

(Continued)

*Primary Examiner* — David M Upchurch
(74) *Attorney, Agent, or Firm* — Procopio, Cory, Hargreaves & Savitch LLP

(57) ABSTRACT

A fastener chain according to the present invention includes left and right fastener stringers. Each fastener stringer includes a fastener tape and an element row. The element row is formed of fastener elements arranged in a coil shape. The fastener tape includes an element-attached portion and a tape bent portion extending from the element-attached portion and bent in a substantially U-shape. The fastener stringers include respective restraining members in contact with the tape bent portions. Each restraining member is formed by deforming a linear member, and the linear member includes a portion extending in a direction for increasing an overall height dimension of the restraining member. Thus, even when a strong lateral pulling force is applied to the fastener tapes while the element rows are in an engaged state, the element rows can be made less visible from the outside of the fastener.

5 Claims, 9 Drawing Sheets

(56) References Cited

U.S. PATENT DOCUMENTS

| | | | | | |
|---|---|---|---|---|---|
| 3,686,719 | A * | 8/1972 | Johnston | A44B 19/36 | 264/445 |
| 3,855,672 | A * | 12/1974 | Takamatsu | A44B 19/12 | 24/394 |
| 3,883,381 | A * | 5/1975 | Thaeler | A41H 37/06 | 156/66 |
| 4,572,088 | A * | 2/1986 | Matsuda | A41H 37/06 | 112/113 |
| 4,593,635 | A * | 6/1986 | Boser | D05B 35/064 | 112/152 |
| 5,446,949 | A * | 9/1995 | Fudaki | A44B 19/38 | 24/433 |
| 8,739,372 | B2 | 6/2014 | Hasegawa et al. | | |
| 2015/0361605 | A1 * | 12/2015 | Nakata | D05B 35/064 | 112/475.16 |

FOREIGN PATENT DOCUMENTS

| | | | |
|---|---|---|---|
| JP | 3186907 | U | 10/2013 |
| WO | 2010/087016 | A1 | 8/2010 |
| WO | 2011/027458 | A1 | 3/2011 |

OTHER PUBLICATIONS

International Preliminary Report on Patentability, with translation, received in corresponding International Application No. PCT/JP2021/036676, mailed Apr. 18, 2024, in 10 pages.

* cited by examiner

FASTENER CHAIN

CROSS-REFERENCE TO RELATED APPLICATIONS

This application is a U.S. national stage application of International Application No. PCT/JP2021/036676, filed Oct. 4, 2021, the contents of which are incorporated by reference.

TECHNICAL FIELD

The present invention relates to a fastener chain for a concealable fastener.

BACKGROUND ART

An example of a known slide fastener is a slide fastener of a concealable type (hereinafter simply referred to as a concealable slide fastener) in which left and right element rows in an engaged state can be covered with fastener tapes so that the element rows are not visible from the outside. The concealable slide fastener is advantageous in that the element rows are covered to reduce effects on the product's design, and is therefore suitable not only for products such as various clothing and bags but also for seat covers for automobiles and trains.

An example of such a concealable slide fastener is disclosed in International Publication No. 2010/087016 (PTL 1). The concealable slide fastener described in PTL 1 includes restraining members that restrain tape bent portions of left and right fastener tapes from moving away from each other while left and right element rows are engaged and the tape bent portions are in close contact with each other. The restraining members are attached to element-attached portions of the fastener tapes. Each restraining member is positioned such that one side edge thereof is in contact with an inner surface of the corresponding tape bent portion when the element rows are engaged. In addition, each restraining member includes a plurality of rectangular thin-plate-shaped restraining bodies and a film-shaped connecting part that connects the restraining bodies in a tape length direction.

According to the concealable slide fastener of PTL 1, when the left and right fastener tapes receive an outward lateral pulling force along a tape width direction while the left and right element rows are engaged, the left and right tape bent portions are easily maintained in an abutted state. Therefore, satisfactory concealing performance can be obtained.

CITATION LIST

Patent Literature

PTL 1: International Publication No. 2010/087016

SUMMARY OF INVENTION

Technical Problem

The concealability of the concealable slide fastener according to PTL 1 is higher than that of a commonly known concealable slide fastener. However, when, for example, a strong lateral pulling force is applied while the element rows are in the engaged state, the left and right tape bent portions abutted against each other may become separated from each other. As a result, there is a possibility that the element rows in the engaged state concealed behind the tape bent portions will be visible from the outside of the concealable slide fastener.

In addition, according to PTL 1, the restraining bodies of the restraining members attached to the fastener tapes are made of a hard synthetic resin. Therefore, there is also a possibility that the flexibility of the concealable slide fastener will be reduced.

The present invention has been made in light of the above-described problem of the related art, and its object is to provide a fastener chain for a concealable fastener in which element rows are not easily visible from the outside of the fastener even when a strong lateral pulling force is applied to the fastener tapes while the element rows are in an engaged state.

Solution to Problem

To achieve the above-described object, the present invention provides a fastener chain for a concealable fastener. The fastener chain includes a pair of left and right fastener stringers. Each fastener stringer includes a fastener tape having a first tape surface and a second tape surface and an element row formed on the first tape surface of the fastener tape. The element row is formed of a plurality of fastener elements arranged continuously in a coil shape. The fastener tape includes at least an element-attached portion and a tape bent portion in cross section of the fastener tape. The element-attached portion has the fastener elements attached thereto. The tape bent portion extends from the element-attached portion and is bent in a substantially U-shape such that the second tape surface serves as an inner peripheral surface. The fastener stringers include respective restraining members that restrain the left and right tape bent portions from moving away from each other, the restraining members being in contact with the second tape surfaces of the tape bent portions. Each restraining member is formed by deforming at least one linear member, and includes a portion that the linear member extends in a direction for increasing an overall height dimension of the restraining member.

In the fastener chain according to the present invention, preferably, each restraining member is attached to the element-attached portion of the fastener tape and disposed continuously along a tape length direction of the fastener tape on the second tape surface of the element-attached portion.

In addition, according to the present invention, preferably, each restraining member has a coil shape obtained by helically deforming the linear member.

In this case, preferably, a first core string is inserted between an upper leg portion and a lower leg portion of each fastener element in a length direction of the element row. A second core string is inserted through each restraining member having the coil shape in a length direction of the restraining member. The element row and the restraining member are sewn together on the element-attached portion with a sewing part formed of a plurality of sewing threads. The sewing part extends through the first core string and the second core string.

In addition, according to the present invention, preferably, each restraining member has a shape obtained by deforming the linear member and including a plurality of bent portions bent in an L-shape.

Advantageous Effects of Invention

According to the fastener chain of the present invention, the element rows are not easily visible from the outside of the fastener even when a strong lateral pulling force is applied to the fastener tapes while the element rows are in an engaged state.

DESCRIPTION OF EMBODIMENTS

A preferred embodiment of the present invention will now be described in detail with reference to the drawings. The present invention is not limited to the embodiment described below in any way, and various changes are possible as long as a configuration substantially the same as that of the present invention is provided and operational effects similar to those of the present invention are obtained.

Figure 1:
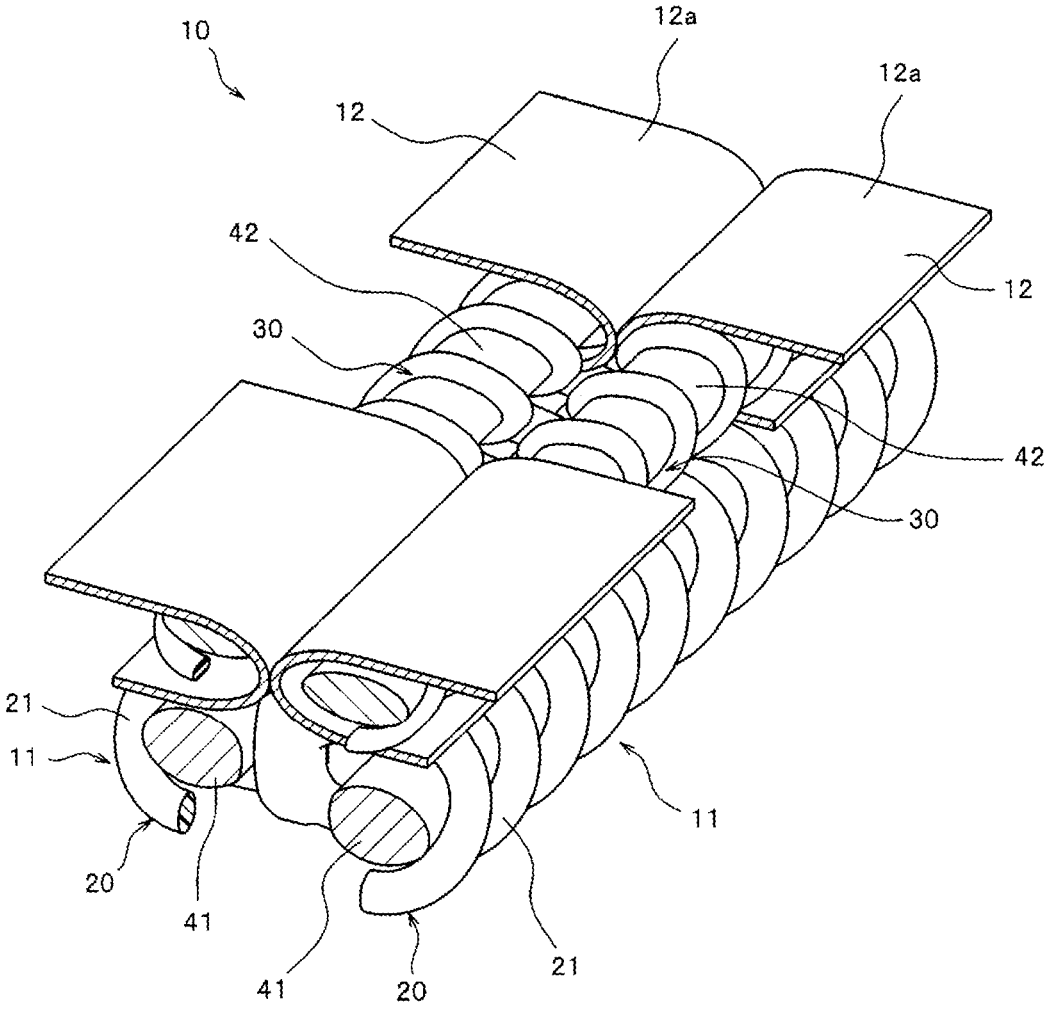
FIG. 1 is a schematic perspective view of part of a fastener chain according to an embodiment of the present invention.
Figure 2:
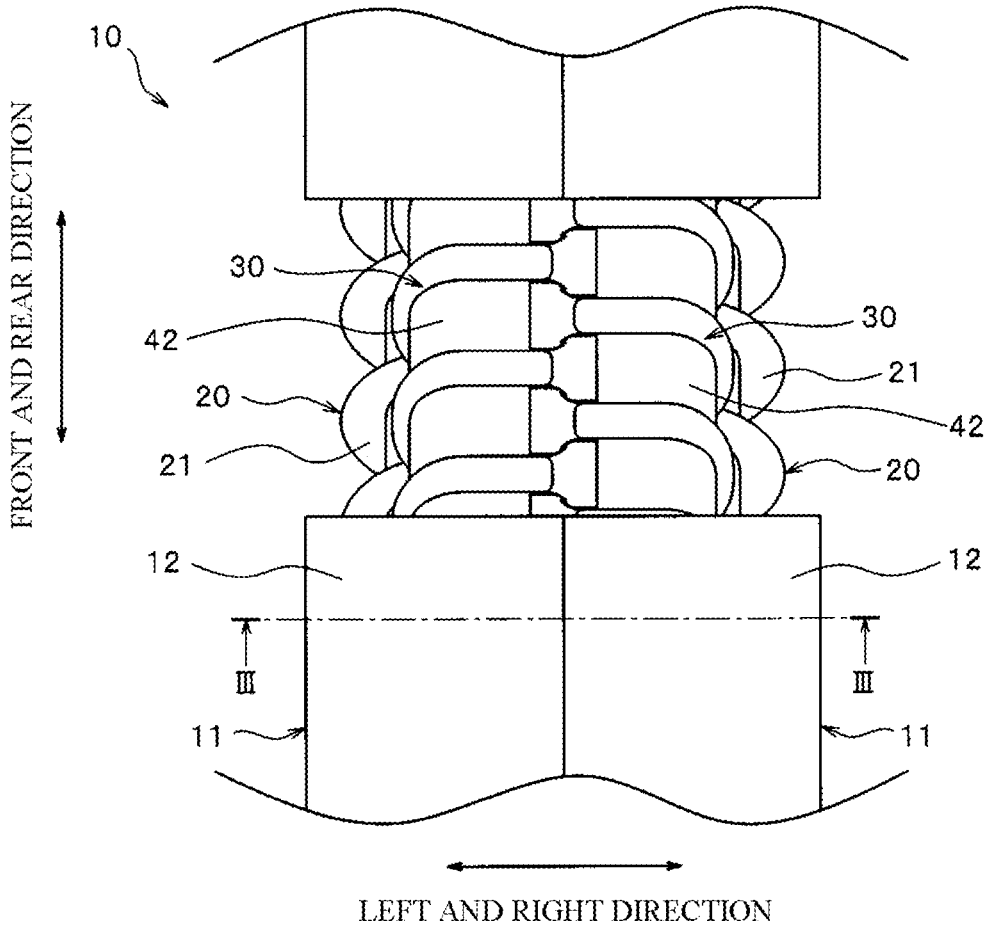
FIG. 2 is a schematic plan view of the fastener chain illustrated in FIG. 1.
Figure 3:
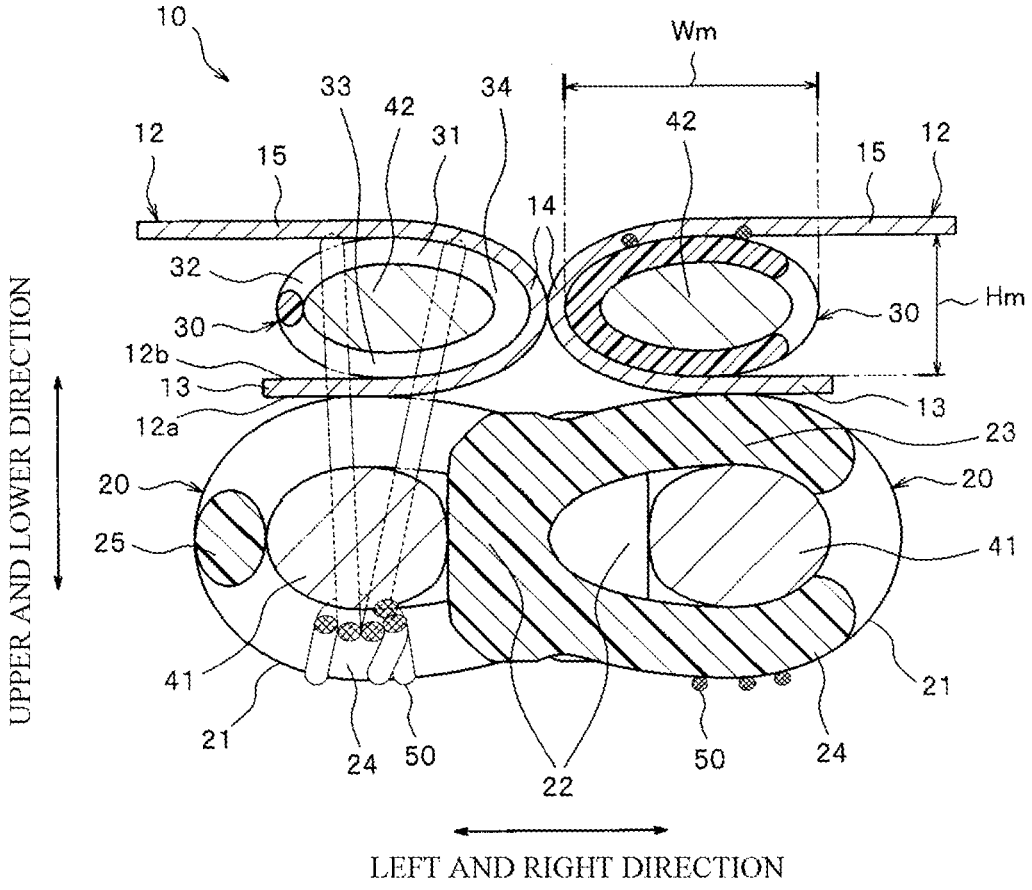
FIG. 3 is a schematic sectional view taken along line III-III in FIG. 2.
Figure 4:
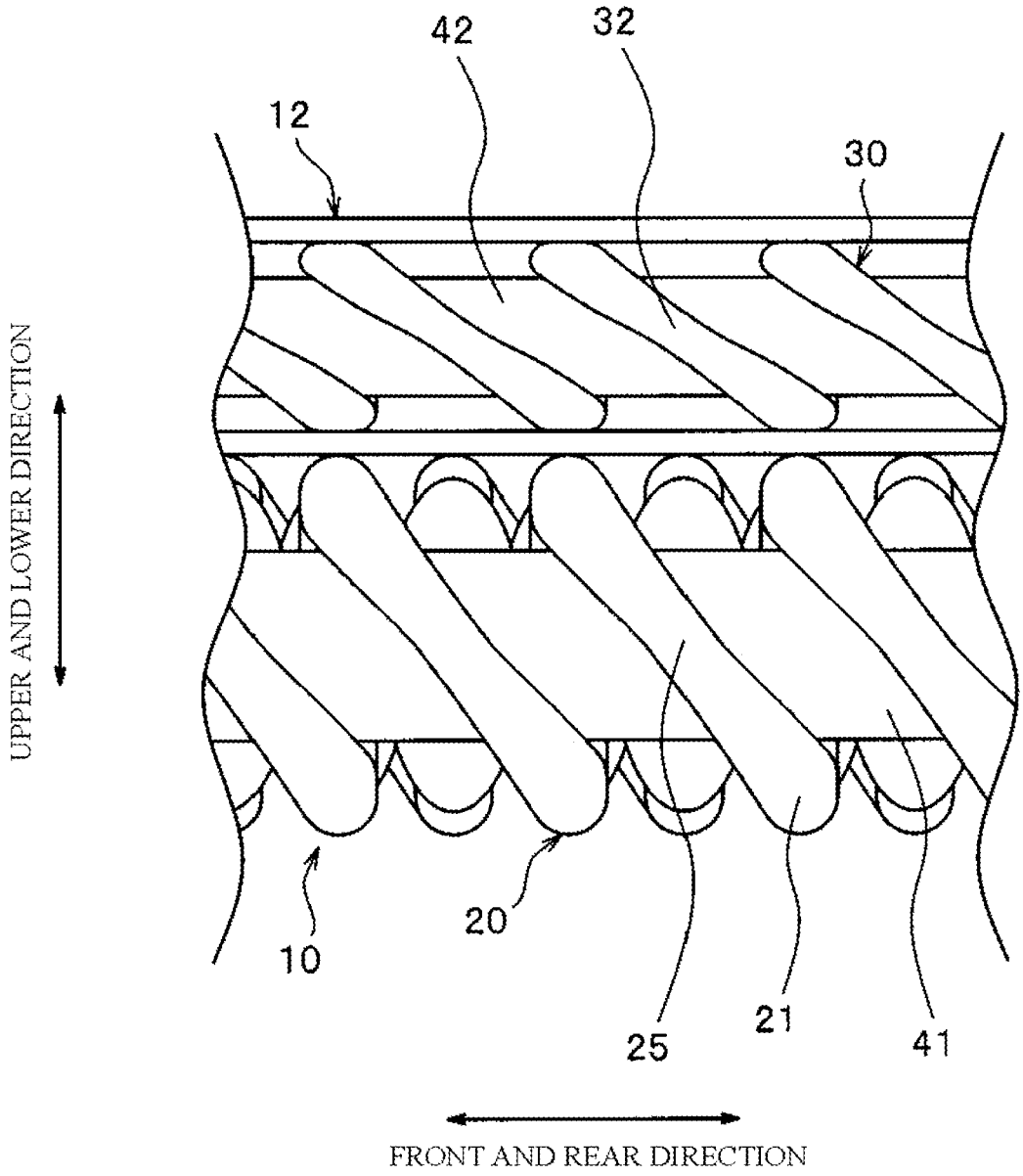
FIG. 4 is a schematic side view of the fastener chain illustrated in FIG. 1.

FIG. 1 is a schematic perspective view of a fastener chain for a concealable fastener according to the present embodiment. FIGS. 2 and 4 are respectively a schematic plan view and a schematic side view of part of the fastener chain. FIG. 3 is a schematic sectional view taken along line III-III in FIG. 2. FIGS. 1 and 2 and FIGS. 6 and 7 illustrating a modification described below each show a fastener chain from which fastener tapes are partially removed to facilitate understanding of the structure of the fastener chain.

In the following description, a front-rear direction is a length direction of a fastener chain 10 or fastener tapes 12, for example, a direction in which an opening-closing member (or slider) is moved to cause left and right element rows 20 to engage with or separate from each other (see FIGS. 2 and 4). Specifically, the front-rear direction is the up-down direction in the plan view of FIG. 2.

The up-down direction is a direction orthogonal to the front-rear direction and along a thickness direction of the fastener chain 10 (see FIGS. 3 and 4). In this case, the direction from fastener elements 21 toward the fastener tapes 12 and restraining members 30 is defined as upward, and the direction opposite thereto is defined as downward. A left-right direction is a direction orthogonal to the front-rear direction and the up-down direction, and is a direction along which the fastener elements 21 move when the element rows 20 are engaged or separated (see FIGS. 2 and 3). Specifically, the up-down direction and the left-right direction are respectively the up-down direction and the left-right direction in the sectional view of FIG. 3.

The concealable fastener according to the present embodiment includes the fastener chain 10 including a pair of left and right fastener stringers 11 and a dedicated opening-closing member (referred to also as a jig) that is not illustrated. The opening-closing member is attachable to and removable from the left and right element rows 20 of the fastener chain 10. In this concealable fastener, the left and right element rows 20 can be engaged with and separated from each other by attaching the opening-closing member (not illustrated) to the element rows 20 and moving the opening-closing member along the element rows 20.

In the present invention, the structure of the opening-closing member is not particularly limited as long as the opening-closing member is attachable to and removable from the left and right element rows 20 and capable of causing the left and right element rows 20 to engage with and separate from each other. In addition, in the present invention, instead of using the opening-closing member, a slider capable of causing the left and right element rows of the fastener chain 10 to engage with and separate from each other may be attached to the element rows 20 in a slidable manner to form the concealable slide fastener.

The fastener chain 10 of the present embodiment includes the pair of left and right fastener stringers 11. Each of the left and right fastener stringers 11 includes the fastener tape 12 having a first tape surface 12*a* and a second tape surface 12*b*; the element row 20 provided on the first tape surface 12*a* of the fastener tape 12; and the restraining member 30 provided on the second tape surface 12*b* of the fastener tape 12 and attached to the fastener tape 12. The fastener tape 12 has the shape of a thin, elongated strip. The fastener tape 12 has the first tape surface 12*a* and the second tape surface 12*b* on opposite sides in a tape thickness direction.

In a cross section orthogonal to a tape length direction of the fastener tapes 12 (see FIG. 3), each fastener tape 12 includes an element-attached portion 13 to which the element row 20 is attached; a tape bent portion 14 that extends from the element-attached portion 13 and that is bent in a substantially U-shape; and a tape extending portion 15 that extends further from the tape bent portion 14. The fastener tape 12 has this cross-sectional shape over the entirety thereof in the length direction of the fastener tape 12.

The first tape surface 12*a* of each fastener tape 12 forms an outer peripheral surface of the substantially U-shaped tape bent portion 14, and the second tape surface 12*b* of each fastener tape 12 forms an inner peripheral surface of the tape bent portion 14. In the fastener chain 10 in which the left and right element rows 20 are engaged, the first tape surfaces 12*a* of portions of the tape bent portions 14 and the tape extending portions 15 serve as chain outer surfaces exposed to the outside of the fastener chain 10.

The element-attached portion 13 of each fastener tape 12 is provided on one side edge of the fastener tape 12. The element-attached portions 13 have the fastener elements 21 constituting the element rows 20 and the restraining members 30 sewn thereon. The tape bent portion 14 of each fastener tape 12 is abutted against the tape bent portion 14 of the other fastener tape 12 when the left and right element rows 20 are engaged, so that the element rows 20 in the engaged state are covered by the fastener tapes 12 and not visible from the outside. The tape extending portions 15 extend outward from the tape bent portions 14 in the left-right direction so as to cover the restraining members 30.

According to the fastener chain 10 of the present embodiment, a fastener-receiving member, such as a seat cover for an automobile, is fixed to a portion of the tape bent portion 14 and the tape extending portion 15 of each fastener tape 12, preferably a portion of the tape bent portion 14, by sewing. When the fastener-receiving member is fixed to the tape bent portion 14 of each fastener tape 12 as described above, the fastener chain 10 can be made non-visible or less visible from the outside of the fastener-receiving member when the left and right element rows 20 are engaged.

Each of the left and right element rows 20 is formed of the fastener elements 21 arranged continuously. The continuous fastener elements 21 are formed by deforming a single monofilament made of a synthetic resin, such as polyamide or polyester, into a coil shape and pressing the monofilament at predetermined intervals to form engaging heads 22 including bulging portions that partially bulge in the front-rear direction.

The fastener elements 21 are formed substantially similarly to commonly known fastener elements formed in a coil shape. More specifically, each fastener element 21 includes the engaging head 22 that engages with the fastener element 21 to be engaged therewith; an upper leg portion 23 and a lower leg portion 24 respectively extending from an upper end and a lower end of the engaging head 22; and a connecting portion 25 that connects an end of the upper leg portion 23 or the lower leg portion 24 to the lower leg portion 24 or the upper leg portion 23 of the fastener element 21 adjacent thereto in the front-rear direction. In this case, the upper leg portion 23 of the fastener element 21 is in contact with the fastener tape 12, and the lower leg portion 24 is separated from the fastener tape 12.

As illustrated in FIG. 3, the fastener elements 21 are fixed to the first tape surface 12*a* of the element-attached portion 13 of each fastener tape 12 by a sewing part 50 together with a first core string 41 while the first core string 41 is inserted between the upper leg portion 23 and the lower leg portion 24 of each fastener element 21 in the front-rear direction or the length direction of each element row 20. Each fastener element 21 is fixed to the fastener tape 12 such that the engaging head 22 thereof projects outward from the position of the tape bent portion 14 of the fastener tape 12 in the left-right direction. Each sewing part 50 is formed in a sewing process described below by performing double-chain-stitch sewing using a plurality of sewing threads. The sewing parts 50 are shown only in FIG. 3, and are omitted in FIGS. 1, 2, and 4 to facilitate understanding of the relationship between the element rows 20 and the restraining members 30.

Each restraining member 30 is coil-shaped. The restraining member 30 is formed by deforming a monofilament made of a synthetic resin, which is a single elongated linear member, into a regular helical shape. Here, the linear member is an elongated member having a constant or substantially constant shape in cross section orthogonal to the length direction. The restraining member 30 has a substantially elliptical outline in a cross section orthogonal to the front-rear direction (FIG. 3). As illustrated in FIG. 4, for example, the restraining member 30 of the present embodiment is formed such that the pitch of the coil shape in the front-rear direction is equal or substantially equal to the pitch of the fastener elements 21 in the front-rear direction.

In the above-described cross section, each coil-shaped restraining member 30 includes: an upper curved portion 31 that convexly curves upward; a left curved portion 32 that extends from a left end of the upper curved portion 31 and convexly curves leftward; a lower curved portion 33 that extends from a lower end of the left curved portion 32 and convexly curves downward; and a right curved portion 34 that extends from a right end of the lower curved portion 33 to be connected to the next upper curved portion 31 and convexly curves rightward.

In this case, the left curved portion 32 and the right curved portion 34 of the restraining member 30 serve as portions of the restraining member 30 in which the monofilament extends in a direction for increasing the overall height dimension of the restraining member 30. Here, the height dimension is the dimension in the up-down direction. In the present embodiment, the upper curved portion 31, the left curved portion 32, the lower curved portion 33, and the right curved portion 34 of the restraining member 30 are, for example, sectioned from each other at boundaries provided at positions at which the tangent line of the outer peripheral surface of the restraining member 30 having a substantially elliptical shape is at an angle of 45° with respect to the up-down or left-right direction in the cross section of the restraining member 30.

While each coil-shaped restraining member 30 is in a state such that a second core string 42 is inserted therethrough in the front-rear direction, the restraining member 30 is fixed to the second tape surface 12*b* of the element-attached portion 13 of the fastener tape 12 with the sewing part 50 together with the second core string 42. The restraining member 30 extends continuously in the front-rear direction over the entirety of the fastener tape 12 in the front-rear direction.

In the present embodiment, a twine or a knit cord obtained by knitting around a bundle of threads, for example, may be suitably used as the first core string 41 and the second core string 42. In the present invention, the material of the first core string 41 and the second core string 42 is not particularly limited. In FIGS. 1 to 4, the second core string 42 is inserted through each coil-shaped restraining member 30 with no gap therebetween. However, in the present invention, a gap may be provided between the restraining member 30 and the second core string 42 as long as the second core string 42 can be sewn on and fixed to the fastener tape 12 together with the restraining member 30.

In the present embodiment, a maximum dimension Wm of the entirety of each restraining member 30 in the left-right direction is greater than a maximum dimension of the first core string 41 in the left-right direction and less than a maximum dimension of the entirety of each fastener element 21 in the left-right direction. In addition, the restraining member 30 is disposed in a region between an outer edge of the engaging head 22 of each fastener element 21 and an outer edge of the connecting portion 25 of the fastener element 21 in the left-right direction.

A maximum dimension Hm of the entirety of each restraining member 30 in the up-down direction is greater than the thickness of the fastener tape 12 and the thickness of the monofilament forming the fastener elements 21.

Each coil-shaped restraining member 30 is flexible, and is easily bendable upward, downward, leftward, and rightward with respect to the front-rear direction. The restraining member 30 sewn on the element-attached portion 13 of the fastener tape 12 is in contact with the second tape surface 12*b* of the tape bent portion 14 of the fastener tape 12, so that the tape bent portion 14 is restrained from moving away from the tape bent portion 14 of the fastener stringer 11 engaged therewith. The restraining member 30 may be of the same size as the fastener elements 21, or larger than the fastener elements 21. The restraining member 30 may be identical to the fastener elements 21.

To manufacture the fastener chain 10 of the present embodiment described above, first, the following are prepared: the elongated strip-shaped fastener tape 12; the fastener elements 21 that are continuous and through which the first core string 41 is inserted; and the coil-shaped restraining member 30 through which the second core string 42 is inserted.

Figure 5:
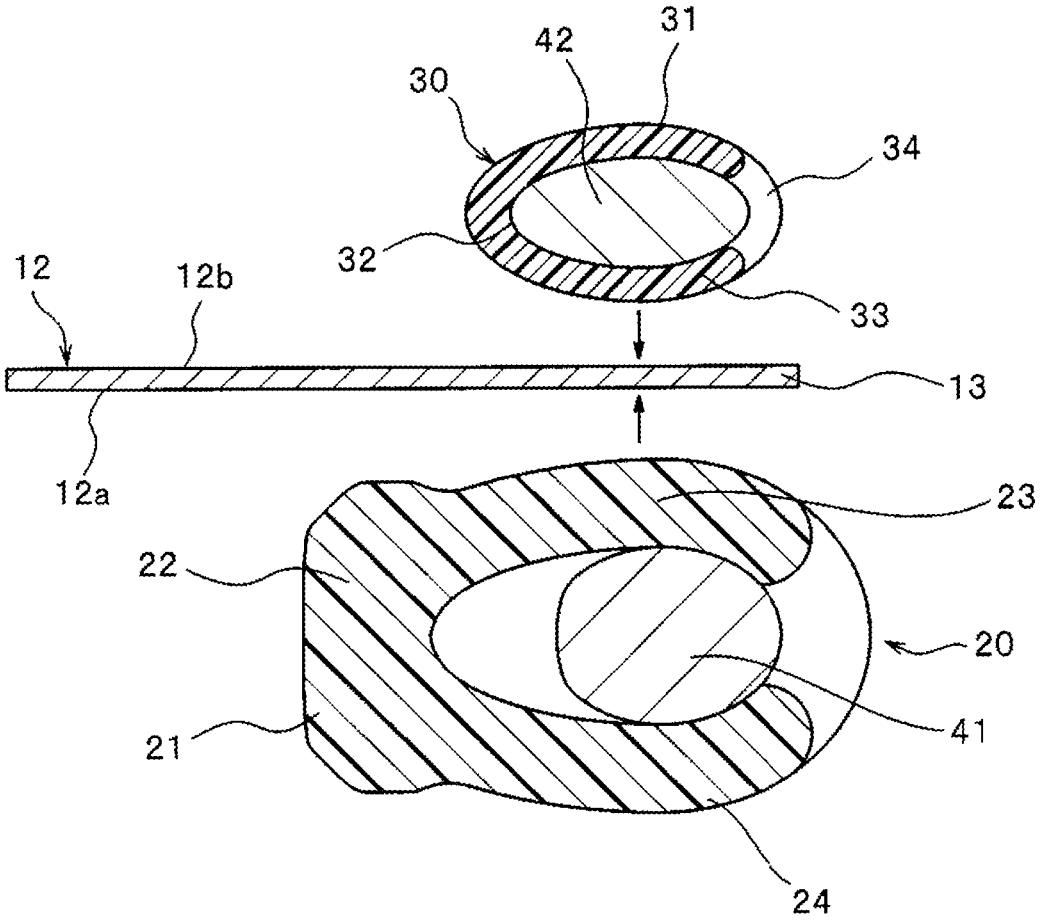
FIG. 5 illustrates a fastener tape, a fastener element, and a restraining member subjected to a sewing process.
Figure 6:
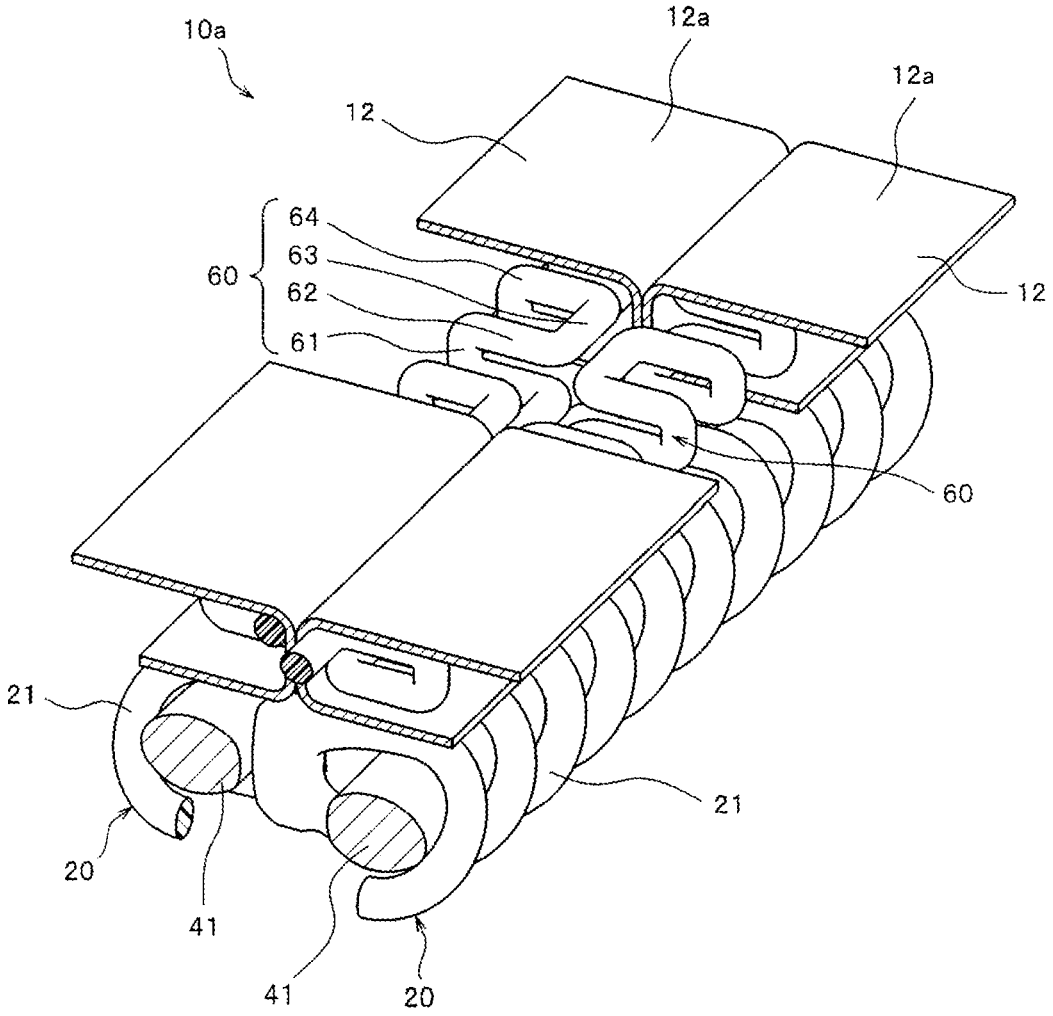
FIG. 6 is a schematic perspective view of part of a fastener chain according to a modification.
Figure 7:
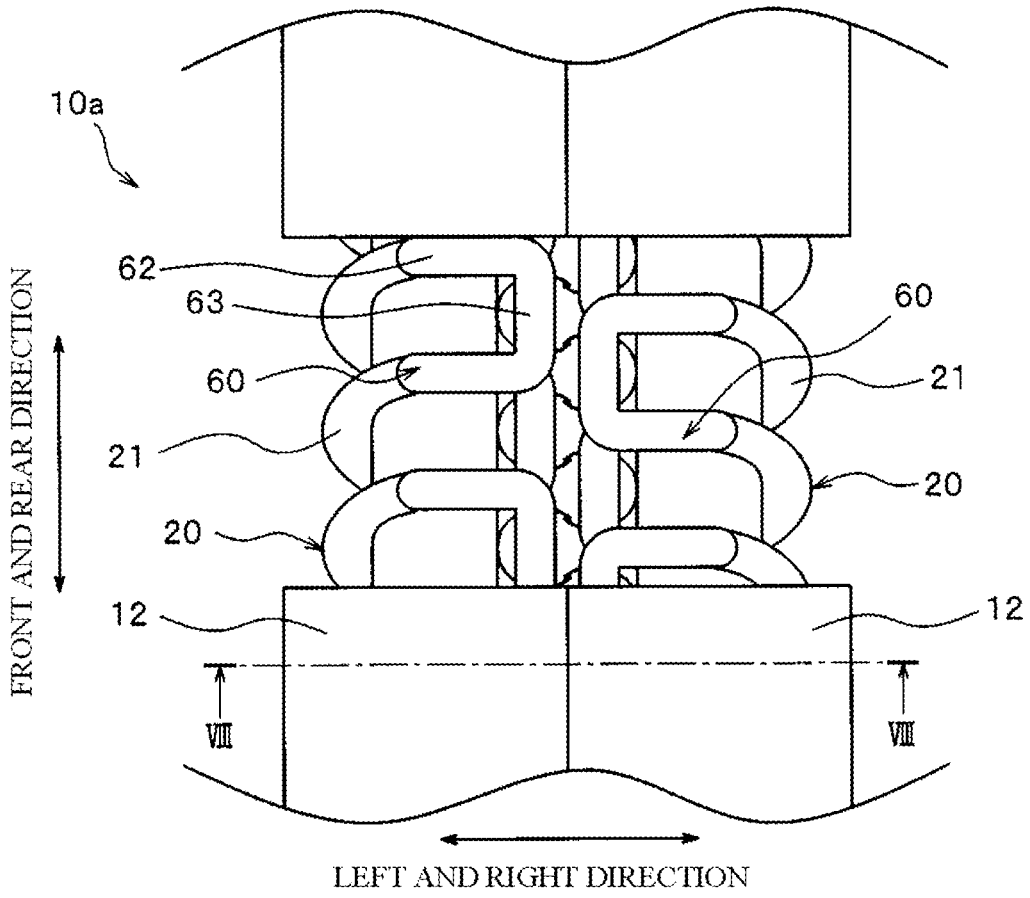
FIG. 7 is a schematic plan view of the fastener chain illustrated in FIG. 6.

Next, as illustrated in FIG. 5, the fastener tape 12 is held flat. In addition, the fastener elements 21 through which the first core string 41 is inserted are brought into contact with the first tape surface 12*a* of the flat fastener tape 12, and the restraining member 30 through which the second core string 42 is inserted is brought into contact with the second tape surface 12*b* of the fastener tape 12. At this time, the fastener elements 21 are brought into contact with the element-attached portion 13 of the fastener tape 12 while the engaging heads 22 thereof face toward the tape extending portion 15 of the fastener tape 12. In addition, the restraining member 30 is brought into contact with the element-attached portion 13 of the fastener tape 12 such that the second core string 42 and the first core string 41 inserted through the fastener elements 21 overlap in the up-down direction.

Subsequently, the fastener elements 21, the restraining member 30, and the fastener tape 12 are set to a sewing machine and subjected to a sewing process while the fastener elements 21 and the restraining member 30 are in contact with the fastener tape 12 as described above. In the sewing process, double-chain-stitch sewing is performed by moving a sewing needle upward and downward so that the sewing needle penetrates through the second core string 42, the fastener tape 12, and the first core string 41. Thus, the sewing part 50 can be formed by using sewing threads in a single sewing process performed by the sewing machine, and the fastener elements 21 and the restraining member 30 can be sewn together and fixed to the element-attached portion 13 of the fastener tape 12 with the sewing part 50. In this case, the sewing part 50 formed by the sewing machine extends through the second core string 42, the fastener tape 12, and the first core string 41. In the present invention, the sewing part 50, with which the fastener elements 21, the fastener tape 12, and the restraining member 30 are fixed, may be formed of a stitch other than the double-chain stitch, such as a lock stitch.

In the present embodiment, after the fastener elements 21 and the restraining member 30 are fixed to the fastener tape 12 by a single sewing process as described above, the fastener tape 12 that has been held flat is bent into a U-shape with the second tape surface 12*b* serving as an inner peripheral surface so that the fastener tape 12 covers the restraining member 30. Thus, the U-shaped tape bent portion 14 of the fastener tape 12 is formed, and the engaging heads 22 of the fastener elements 21 project beyond the position of the first tape surface 12*a* of the tape bent portion 14 in the left-right direction.

After that, the fastener tape 12 is subjected to heat setting while the fastener tape 12 is in the bent state, so that the shape of the fastener tape 12 is stabilized.

Thus, the fastener stringer 11 according to the present embodiment is manufactured. Two fastener stringers 11 are manufactured as a pair, and the element rows 20 thereof are engaged with each other. Thus, the fastener chain 10 according to the present embodiment illustrated in FIGS. 1 to 4 is manufactured.

When the manufactured fastener chain 10 is attached to, for example, a seat cover (not illustrated) of an automobile that serves as a fastener-receiving member, at least a portion of the tape bent portion 14 and the tape extending portion 15 of each fastener tape 12, preferably at least a portion of the tape bent portion 14, is caused to overlap the seat cover, and the overlapping portions are subjected to a sewing process so that the fastener tape 12 is sewn on the seat cover. Thus, the seat cover to which the fastener chain 10 is attached can be obtained. The fastener chain 10 of the present embodiment may also be used for products other than the seat cover, such as clothing and bags.

In the above-described fastener chain 10 of the present embodiment, when the left and right element rows 20 are engaged with each other, the tape bent portions 14 of the left and right fastener tapes 12 are abutted against each other. In addition, the coil-shaped restraining members 30 fixed to the element-attached portions 13 of the fastener tapes 12 are in contact with the second tape surfaces 12*b* of the tape bent portions 14 of the fastener tapes 12, so that the left and right tape bent portions 14 are maintained abutted against each other in close contact with each other. Accordingly, the left and right element rows 20 in the engaged state are covered by the left and right fastener tapes 12 and are not visible from the outside of the fastener chain 10 (from above in FIG. 3).

In the fastener chain 10 in which the left and right element rows 20 are engaged, the fastener tapes 12 may, for example, receive a tensile force or a lateral pulling force from the seat cover, which is the fastener-receiving member, in a direction for separating the left and right tape bent portions 14 from each other. In such a case, since the left and right coil-shaped restraining members 30 are in contact with the respective tape bent portions 14 to restrain the tape bent portions 14 from moving away from each other, the left and right tape bent portions 14 can be easily maintained in close contact with each other as described above.

Furthermore, if the left and right fastener tapes 12 receive a very strong tensile force or lateral pulling force, for example, there is a possibility that the left and right tape bent portions 14 will be separated from each other even when the tape bent portions 14 are restrained from moving by the coil-shaped restraining members 30. However, in the fastener chain 10 of the present embodiment, since the restraining members 30 are coil-shaped, the overall height dimension of the restraining members 30 is greater than, for example, that of the restraining members described in PTL 1. Therefore, the left and right element rows 20 in the engaged state are spaced by a large distance from the tape surfaces of the fastener tapes 12 that constitute the outer surface of the fastener chain 10.

As a result, even when the left and right fastener tapes 12 receive a strong tensile force or lateral pulling force as described above and the left and right tape bent portions 14 move against the restraining force applied by the restraining members 30 such that a gap is formed therebetween (that is, even when the left and right fastener tapes 12 are released from the close contact state), the left and right element rows 20 are spaced from the outer surface of the fastener chain 10 in the up-down direction. Therefore, the left and right element rows 20 are not easily visible from the outside of the fastener chain 10 through the gap between the left and right tape bent portions 14.

In particular, in this case, since the element rows 20 are spaced by a large distance from the outer surface of the fastener chain 10, even when a gap is formed between the left and right tape bent portions 14, the gap between the tape bent portions 14 appears dark because light does not easily reach the element rows 20. As a result, the left and right element rows 20 can be made less visible.

Thus, according to the fastener chain 10 for the concealable fastener of the present embodiment, when the fastener tapes 12 receive a tensile force or a lateral pulling force, the left and right element rows 20 can be made less visible compared to those in the concealable slide fastener according to the related art described in PTL 1. Therefore, the concealability of the element rows 20 can be increased. Accordingly, degradation of the appearance quality or design of the product to which the fastener chain 10 is attached due to exposure of the element rows 20 can be suppressed.

In addition, in the fastener chain 10 of the present embodiment, since the restraining members 30 are coil-shaped, each of the left and right fastener stringers 11 can be highly flexible. Therefore, the reduction in flexibility of the fastener chain 10 due to the installation of the restraining members 30 can be suppressed, so that the fastener chain 10 can be easily bent in the up-down direction and the left-right direction, in particular, in the left-right direction, with respect to the front-rear direction.

Thus, the fastener chain 10 of the present embodiment can be easily attached to the fastener-receiving member, such as the seat cover, while the fastener chain 10 is curved in, for example, the left-right direction. In addition, when the fastener chain 10 is attached to the fastener-receiving member in, for example, an arc shape curved in the left-right direction, the fastener chain 10 can be attached to the fastener-receiving member in an arc shape with a smaller radius of curvature compared to the known slide fastener. As a result, the range of uses of the fastener chain 10 can be expanded, and the appearance quality and design of the product to which the fastener chain 10 is attached can be improved.

In the fastener chain 10 of the above-described embodiment, the restraining members 30 are coil-shaped, and the second core string 42 is inserted through each restraining member 30. However, in the present invention, the form of the restraining member for restricting the movement of the tape bent portion 14 of each fastener tape 12 is not limited to this. The restraining member of the present invention may be any restraining member that is formed by deforming a linear member and in which the linear member includes a portion that extends in a direction for increasing the overall height dimension of the restraining member. For example, the restraining member according to the present invention may have a zigzag shape including a plurality of bent portions bent in an L-shape as in a fastener chain 10*a* according to a modification illustrated in FIGS. 6 to 9.

More specifically, zigzag-shaped restraining members 60 illustrated in FIGS. 6 to 9 are each shaped such that first columnar portions 61 extending in the up-down direction, second columnar portions 62 extending in the left-right direction, and third columnar portions 63 extending in the front-rear direction are regularly arranged. Connecting portions connecting the different types of columnar portions, that is, the first columnar portions 61, the second columnar portions 62, and the third columnar portions 63, are formed of bent portions 64 that are bent in an L-shape.

Each zigzag-shaped or L-shaped restraining member 60 is formed by deforming a monofilament made of a synthetic resin, which is a single elongated linear member, to form the above-described L-shaped bent portions 64 on the monofilament. In this case, the first columnar portions 61 extending in the up-down direction serve as portions of the restraining member 60 in which the monofilament extends in the direction for increasing the overall height dimension of the restraining member 60.

Figure 8:
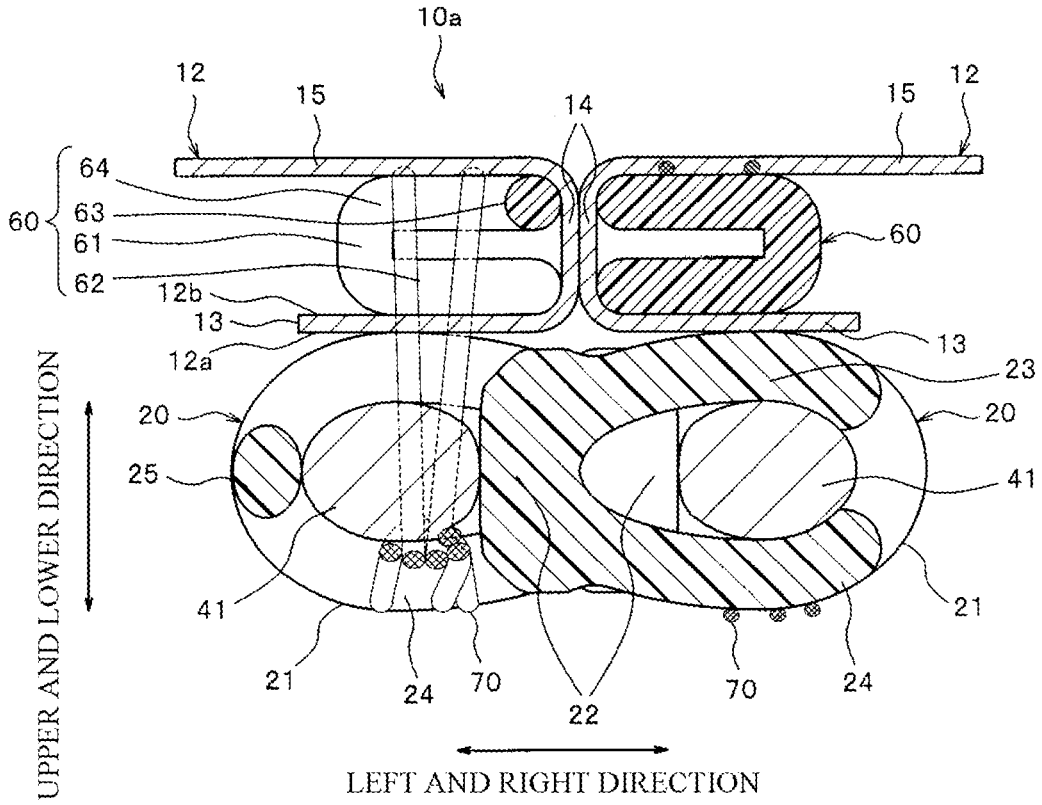
FIG. 8 is a schematic sectional view taken along line VIII-VIII in FIG. 7.
Figure 9:
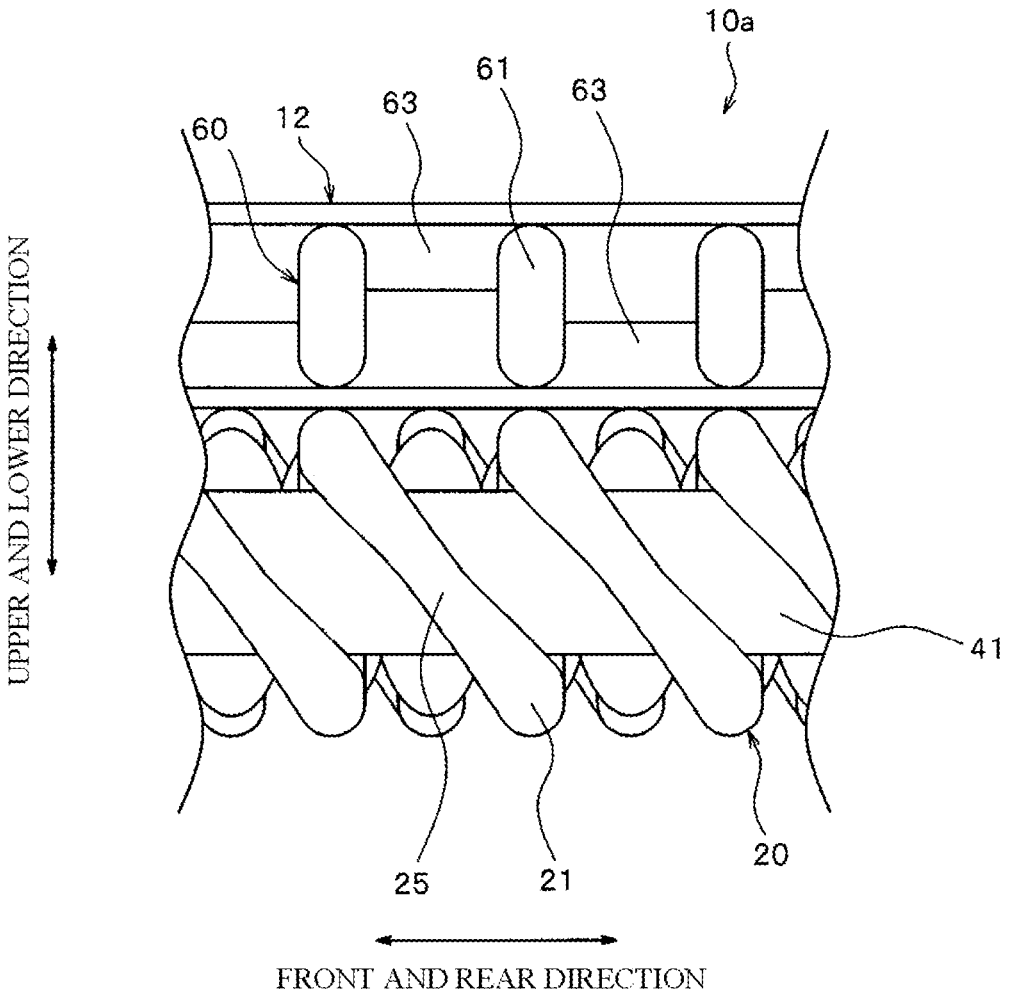
FIG. 9 is a schematic side view of the fastener chain illustrated in FIG. 6.

As illustrated in FIG. 8, each zigzag-shaped restraining member 60 does not have the second core string 42 of the above-described embodiment inserted between the upper and lower second columnar portions 62 extending in the left-right direction, and only the zigzag-shaped restraining member 60 is sewn on and fixed to the second tape surface 12*b* of the element-attached portion 13 of the fastener tape 12. In addition, each zigzag-shaped restraining member 60 is fixed to the element-attached portion 13 together with the fastener elements 21 by a sewing part 70. Each sewing part 70 is formed in a sewing process by performing double-chain-stitch sewing using a plurality of sewing threads. In this modification, the sewing parts 70 are shown only in FIG. 8, and are omitted in FIGS. 6, 7, and 9.

The fastener chain 10*a* according to this modification is formed substantially similarly to the fastener chain 10 according to the embodiment except that the zigzag-shaped restraining members 60 are used instead of the restraining members 30 and the second core strings 42 in the fastener chain 10 according to the above-described embodiment. Therefore, members and components of the fastener chain 10*a* of this modification that are substantially similar to those in the embodiment are denoted by the same reference signs, and description thereof will be omitted. In this modification, each zigzag-shaped restraining member 60 may be sewn on the element-attached portion 13 of the fastener tape 12 by the sewing part 70 together with a second core string while the second core string is inserted between the upper and lower second columnar portions 62 in the front-rear direction.

Each zigzag-shaped restraining member 60 according to the modification is flexible, and is easily bendable upward, downward, leftward, and rightward with respect to the front-rear direction. The zigzag-shaped restraining member 60 is fixed to the element-attached portion 13 while being in contact with the second tape surface 12*b* of the tape bent portion 14 of the fastener tape 12. Therefore, the zigzag-shaped restraining member 60 restrains the tape bent portion 14 from moving away from the tape bent portion 14 of the fastener stringer 11 engaged therewith.

The fastener chain 10*a* including the above-described zigzag-shaped restraining members 60 also provides effects similar to those of the fastener chain 10 including the coil-shaped restraining members 30 of the above-described embodiment.

In the above-described embodiment and modification, the restraining members 30 and 60 are formed by deforming a monofilament made of a synthetic resin. However, in the present invention, the material of the restraining members 30 and 60 is not particularly limited. Each restraining member of the present invention may be formed by, for example, deforming a metal linear member, such as a wire, into a coil shape or a zigzag shape including a plurality of bent portions bent in an L-shape. Alternatively, each restraining member may be formed of, for example, a metal coil spring.

REFERENCE SIGNS LIST

10, 10*a* fastener chain
11 fastener stringer
12 fastener tape
12*a* first tape surface
12*b* second tape surface
13 element-attached portion
14 tape bent portion
15 tape extending portion
20 element row
21 fastener element
22 engaging head
23 upper leg portion
24 lower leg portion
25 connecting portion

30 restraining member
31 upper curved portion
32 left curved portion
33 lower curved portion
34 right curved portion
41 first core string
42 second core string
50 sewing part
60 restraining member
61 first columnar portion
62 second columnar portion
63 third columnar portion
64 bent portion
70 sewing part
Hm maximum dimension of entirety of restraining member in up-down direction
Wm maximum dimension of entirety of restraining member in left-right direction

The invention claimed is:

1. A fastener chain for a concealable fastener, the fastener chain including a pair of left and right fastener stringers, each fastener stringer including a fastener tape having a first tape surface and a second tape surface and an element row formed on the first tape surface of the fastener tape, the element row being formed of a plurality of fastener elements arranged continuously in a coil shape, the fastener tape including at least an element-attached portion and a tape bent portion in cross section of the fastener tape, the element-attached portion having the fastener elements attached thereto, the tape bent portion extending from the element-attached portion and being bent in a substantially U-shape such that the second tape surface serves as an inner peripheral surface, wherein the fastener stringers include respective restraining members that restrain the left and right tape bent portions from moving away from each other, the restraining members being in contact with the second tape surfaces of the tape bent portions; and each restraining member is formed by deforming at least one linear member, and includes a portion that the linear member extends in a direction for increasing an overall height dimension of the restraining member.

2. The fastener chain according to claim 1, wherein each restraining member is attached to the element-attached portion of the fastener tape and disposed continuously along a tape length direction of the fastener tape on the second tape surface of the element-attached portion.

3. The fastener chain according to claim 1, wherein each restraining member has a coil shape obtained by helically deforming the linear member.

4. The fastener chain according to claim 3, wherein a first core string is inserted between an upper leg portion and a lower leg portion of each fastener element in a length direction of the element row, wherein a second core string is inserted through each restraining member having the coil shape in a length direction of the restraining member, wherein the element row and the restraining member are sewn together on the element-attached portion with a sewing part formed of a plurality of sewing threads, and wherein the sewing part extends through the first core string and the second core string.

5. The fastener chain according to claim 1, wherein each restraining member has a shape obtained by deforming the linear member and including a plurality of bent portions bent in an L-shape.

* * * * *